US008381670B2

(12) United States Patent
Willén et al.

(10) Patent No.: US 8,381,670 B2
(45) Date of Patent: Feb. 26, 2013

(54) SEMI-SUBMERSIBLE PLATFORM BODY FOR SUPPORTING DRILLING, STORING, TREATMENT OR PRODUCTION OF HYDROCARBONS AT SEA

(75) Inventors: Efva Willén, Göteborg (SE); Magnus Malo, Torslanda (SE); Erik Svensson, Göteborg (SE)

(73) Assignee: GVA Consultants AB, Goteborg (SE)

( * ) Notice: Subject to any disclaimer, the term of this patent is extended or adjusted under 35 U.S.C. 154(b) by 237 days.

(21) Appl. No.: 12/867,136

(22) PCT Filed: Feb. 6, 2009

(86) PCT No.: PCT/SE2009/050125

§ 371 (c)(1),
(2), (4) Date: Oct. 13, 2010

(87) PCT Pub. No.: WO2009/102269

PCT Pub. Date: Aug. 20, 2009

(65) Prior Publication Data

US 2011/0041753 A1 Feb. 24, 2011

Related U.S. Application Data

(60) Provisional application No. 61/028,546, filed on Feb. 14, 2008.

(30) Foreign Application Priority Data

Feb. 14, 2008 (SE) ..... 0800340

(51) Int. Cl.
*B63B 35/44* (2006.01)

(52) U.S. Cl. ..... 114/264; 114/265

(58) Field of Classification Search ..... 114/264, 114/265, 266; 405/204, 208, 224
See application file for complete search history.

(56) References Cited

U.S. PATENT DOCUMENTS

| | | | |
|---|---|---|---|
| 3,894,504 | A | 7/1975 | Smith |
| 4,498,412 | A | 2/1985 | Liden |
| 4,502,551 | A | 3/1985 | Rule et al. |

(Continued)

FOREIGN PATENT DOCUMENTS

| | | |
|---|---|---|
| GB | 2038261 | 7/1980 |
| GB | 2169570 | 7/1986 |

(Continued)

*Primary Examiner* — Lars A Olson
(74) *Attorney, Agent, or Firm* — KBR IP Legal Dept.

(57) ABSTRACT

The present invention relates to a semi-submersible platform body for supporting drilling, storing, treatment or production of hydrocarbons. The platform body have a cross section with a center point in a first plane, and is defined by a side wall formed by at least one side wall section, the side wall is arranged around the periphery of an open recess. Each side wall section comprises a first and a second side, an upper and a lower edge, the first and second side of the side wall section defines at least a first side wall thickness. The first side of the side wall section faces away from the open recess and the second side of the side wall section faces towards the open recess. The mentioned open recess has a cross section with a center point in the first plane. Further is the center point of the cross section of the open recess displaced a distance in the first plane, from the center point of the cross section of the platform body. The present invention provides for a flexible and versatile platform body which is disposed of the need for custom applications of heavy equipment or facilities in order to prevent displacement of the center of buoyancy.

24 Claims, 5 Drawing Sheets

U.S. PATENT DOCUMENTS

| | | | | | |
|---|---|---|---|---|---|
| 4,571,125 | A | | 2/1986 | Oshima et al. | |
| 5,833,397 | A | * | 11/1998 | Horton, III | 405/204 |
| 6,125,780 | A | * | 10/2000 | Sweetman et al. | 114/264 |
| 6,260,502 | B1 | * | 7/2001 | Kratz et al. | 114/264 |
| 6,945,736 | B2 | | 9/2005 | Smedal et al. | |
| 2005/0058513 | A1 | | 3/2005 | Martensson et al. | |

FOREIGN PATENT DOCUMENTS

| | | | |
|---|---|---|---|
| GB | 2310634 | | 9/1997 |
| GB | 2310832 | | 9/1997 |
| GB | 2292348 | | 2/1998 |
| WO | WO0228704 | A1 | 4/2002 |

* cited by examiner

SEMI-SUBMERSIBLE PLATFORM BODY FOR SUPPORTING DRILLING, STORING, TREATMENT OR PRODUCTION OF HYDROCARBONS AT SEA

CROSS REFERENCE TO RELATED APPLICATIONS

This application is the National Stage of International Application No. PCT/SE2009/050125, filed 6 Feb. 2009 which claims the benefit of U.S. Provisional Application No. 61/028,546, filed 14 Feb. 2008 and Swedish Application No. 0800340-2, filed 14 Feb. 2008.

TECHNICAL FIELD

The present invention relates to a semi-submersible platform body for supporting drilling, storing, treatment or production of hydrocarbons at sea. A semi-submersible platform body according to the present invention is generally used as an offshore platform for drilling, storing, treatment or production of hydrocarbons.

BACKGROUND OF THE INVENTION

Semi-submersible offshore platforms are frequently used when drilling, producing or storing hydrocarbons, such as oil and gas, at sea. They are best known for their ability to withstand the environmental forces subjected to the platform by the wind and the sea, primarily in terms of movements and independency of direction of the environmental forces.

Conventional semi-submersible offshore platforms are used primarily in offshore locations where the water depth exceeds about 90 m. This type of platform comprises a hull structure that has sufficient buoyancy to support the equipment deck above the surface of the water. The hull typically comprises one or more submersible pontoons that support a plurality of vertically upstanding columns, which in turn support the deck above the surface of the water. The size of the pontoons and the number of columns are governed by the size and weight of the deck and equipment being supported.

One example of such a semi-submersible offshore platform is described in the patent publication of GB 2,310,634. The semi-submersible platform for storing liquid hydrocarbons comprises a superstructure and six spaced apart legs extending from the superstructure. The superstructure can be equipped with buildings and drilling or production equipment. Each of the legs is divided by an internal wall which defines a storage tank spaced radially inwardly from each of the respective leg. The legs are rigidly interconnected at end portions thereof which are disposed remote from the superstructure by a ring pontoon. Likewise, in the patent publication with the U.S. Pat. No. 4,498,412 is a semi-submersible offshore platform described. The platform comprises an operating deck carried by four cylindrical columns supported by a pontoon structure comprising four sided boxes formed into a square ring.

The above mentioned platforms each utilize the well established technique of using a plurality of columns to minimize the effect of the environmental forces as well as obtaining an appropriate stability of the platform. The wind and the sea can pass underneath the operating deck while the plurality of columns imposes stability to the operating deck by providing several support points to the sea. However, this advantage comes with the price of subjecting pipes and drilling equipment, which extends between the operating deck and the sea floor, to the same environmental forces.

This drawback has been at least partly solved by the platform described in the publication of U.S. Pat. No. 6,945,736 B2. The platform is designed mainly as a vertical flat bottomed cylinder and comprises a centrally arranged vertical through shaft, also referred to as a moonpool, for receiving of risers or other drilling equipment. The cylinder wall comprises a number of tanks in which liquid can be stored. However as the need for offshore solutions increases, the need for platform bodies which are capable of taking on a wide variety of facilities and equipment are needed. When larger facilities, e.g. production facilities, are positioned on platform bodies, there is a constant need to maintain the point of balance so that any facility not risk of shifting the point of balance in an unwanted or unexpected direction. Usually these shifts can be contravened by moving ballast between ballast tanks to compensate of the diversions in point of balance. When storing huge quantities of hydrocarbons this compensation however provides losses in storage capacity. This is indeed a deficiency of known solutions.

SUMMARY OF THE INVENTION

It is an object of the present invention to at least partly solve the above mentioned drawbacks. More specifically are they at least partly solved by a semi-submersible platform body for supporting drilling, storing, treatment or production of hydrocarbons, according to the present invention. The platform body comprises a cross section with a centre point, and is defined by a side wall formed by at least one side wall section. The side wall is arranged around the periphery of an open recess. Each side wall section comprises a first and a second side, an upper and a lower edge. The first and second side of the side wall section defines at least a first side wall thickness, wherein the first side of the side wall section faces away from the open recess and the second side of the sidewall section faces towards the open recess. The open recess comprises a cross section comprising a centre point. The centre point of the cross section of the open recess is displaced from the centre point of the cross section of the platform body. The present invention provides for a platform body which can effectively compensate for any facility, equipment or other arrangements which could affect the point of balance if the platform body. It provides for a shift in horizontal centre of buoyancy which permits a corresponding shift in centre of gravity which may occur when carrying e.g. LNG plants. The platform body is thereby a very versatile platform body for storing, offloading, treating or producing hydrocarbons at sea since the required facilities do not need to be customized so as to fit with the point of balance with the platform body. Instead is the platform body itself already asymmetric in terms of the point of balance due to the offset of the centre points of respective cross section of the open recess and the platform body. Further advantages and objectives of the present invention will be crystallized when reading the following description.

In an embodiment of the present invention, the centre point of the cross section of the open recess is displaced from the centre point of the cross section of the platform body with a distance of between 0.1 to 40 m, preferably 3-30 m.

The platform body can comprise a circular cross section or a polygonal cross section. An embodiment in which the platform body comprises a polygonal cross section, the side wall comprises at least a first, second and third side wall section. At least the first of the side wall sections comprises a side wall thickness which is at least 105% of the side wall thickness of the second or third side wall sections. Alternatively, the platform body comprises a substantially rectangular cross section with a first, second, third and fourth side wall section, and in that the first side wall section comprises a side wall thickness which is at least 105% of the second, third or fourth side wall sections. These platform bodies has been found to be extra advantageous in waters which have waves with somewhat lower maximum wave elevation.

Embodiments of the present invention in which the platform body comprises a substantial rectangular cross section can comprise a first and second side wall sections with a side wall thickness which is at least 105% of the third or the fourth side wall section. Optionally can the first, second and third side wall sections comprise a side wall thickness which is at least 105% of the fourth side wall section. These different embodiments give different aspects, flexibility and prerequisites for deploying hydrocarbons to the platform body, without the drawbacks of a decreased storage capacity.

In an embodiment according to the present invention, the cross section of the open recess can comprise a polygonal cross section, preferably a substantially rectangular cross section. This has been found to be practical for docking and mating reasons.

One object of the present invention is to provide for a decrease of the maximum wave elevation which can occur inside the open recess. As an effect of a decreased maximum wave elevation, not only can the centre of gravity of the platform body be lowered, e.g. by lowering an operational deck, as much as possible, but it also lessens the strain on raisers or drilling equipment which might be arranged inside the open recess. This can be accomplished by different means, and in its most general terms, the cross section of the open recess and the cross section of the platform body can both be arranged in a first plane, and the side wall thickness above the first plane is different than the side wall thickness below the first plane. Optionally can the cross section of the open recess in the first plane have a first cross sectional area, and the open recess have a second cross sectional area below the first plane, wherein the first cross sectional area is at least 10%, preferably 20%, larger than the second cross sectional area. In an embodiment according to the present invention, the side wall thickness below the first plane is continuously increasing towards the lower edge of the side wall section.

The side wall comprises a bottom. The bottom defines, together with the open recess, a side wall bottom surface area and a third cross section area of the open recess, in the plane of the bottom surface area. The third cross section area of the open recess is in an embodiment according to the present invention, less than 50%, less than 60% or optionally less than 70%, of the bottom surface area.

The first side of any, or a specified side wall section can be substantially vertical while the second side of the same side wall section is arranged with an angle, with respect to the first side of the side wall section, so that the above mentioned increase in the side wall thickness (Wt) is effected.

These different embodiments according to the present invention all contribute to a reduced maximum wave elevation in the open recess, which thereby provides for a reduction of the static air gap inside the open recess.

An operational deck can be positioned on top of the platform body to partly or fully cover the open recess. However, a preferred embodiment of the present invention is a platform body with a first operational deck which is arranged below the upper edge of the at least one side wall section. This embodiment fully takes advantage of the lowered maximum wave elevation present inside the open recess with all the advantages as described above. As is evident, the first side of the side wall section, comprises a first air gap and the second side of the side wall section comprises a second air gap, wherein in the first operational deck is arranged below the first air gap. By lowering the operational deck the centre of gravity is reduced in the vertical direction. Further is the operational deck provided with a protective wall, this has been shown is very lenient towards the working staff and equipment.

In an additional embodiment according to the present invention, the cross section of the platform body has an area, and the cross section of the open recess has a first cross section area, wherein the ratio between the area of the cross section of the platform body and the first cross section area is at least 1.1:1, preferably between 1.1:1-15:1, more preferably between 1.1:1-10:1.

The semi-submersible platform body according to an embodiment of the present invention, the side wall comprises at least two side wall sections, wherein at least one of the side wall sections comprises an upper edge arranged below the upper edge of the remaining side wall sections. Optionally the side wall comprises at least three side wall sections, wherein at least two of the side wall sections comprises an upper edge arranged below the upper edge of the remaining side wall sections.

DEFINITIONS

By the term "hydrocarbons" is meant compounds which are mainly based on carbon and hydrogen, such as fossil fuel e.g. oil, natural gas, or any derivatives there from.

By the term "semi-submersible platform body" is meant a platform body having a length L, a width W, wherein the width is at least 50% of the length L, and the length L is larger than the draught of the platform body, during normal operation at sea.

BRIEF DESCRIPTION OF THE DRAWINGS

The present invention will be described in greater detail with references to the accompanying figure wherein.

DETAILED DESCRIPTION OF PREFERRED EMBODIMENTS

Figure 1:
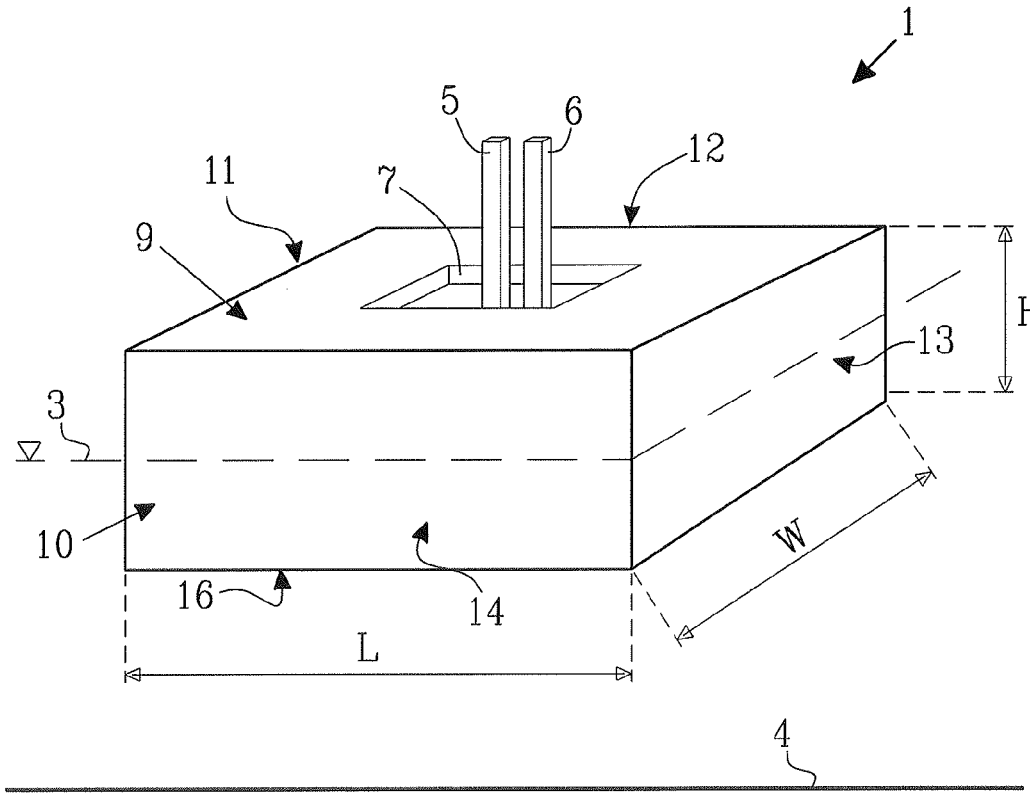
FIG. 1 show a schematic semi-submersible platform body, according to an embodiment of the present invention, for supporting, storing and drilling of hydrocarbons at sea, with a view in perspective.

In FIG. 1 is a semi-submersible platform 1 for storing hydrocarbons, such as liquid natural gas (LNG) shown with a view from the side. The platform 1 comprises a platform body 10, according to the present invention, in which hydrocarbon can be stored in tanks or compartments. An operational deck 7 is arranged to the platform body to support equipment and possibly buildings etc. The semi-submersible platform body 10 is shown after deployment for normal operation at sea. Hence all references which refer to relative directions should be interpreted as being with respect the platform body 10, according to the present invention, after deployment during normal operation at sea. Further is the sea level 3 shown extending substantially horizontal with respect to the platform body 10, and likewise is the sea floor 4 shown beneath the platform body 10. A first and a second drilling rig 5, 6 is arranged on the operational deck 7. The platform body 10 comprises a substantially rectangular shaped hull formed by a side wall 9 enclosing an open recess, the side wall 9 comprises four side wall sections 11, 12, 13, 14. The platform body exhibits a length L, a width W and a height H. The width W is at least 50% of the length L. In an preferred embodiment of the present invention is the width W at lest 60%, more preferred at least 70% of the length L.

Figure 2:
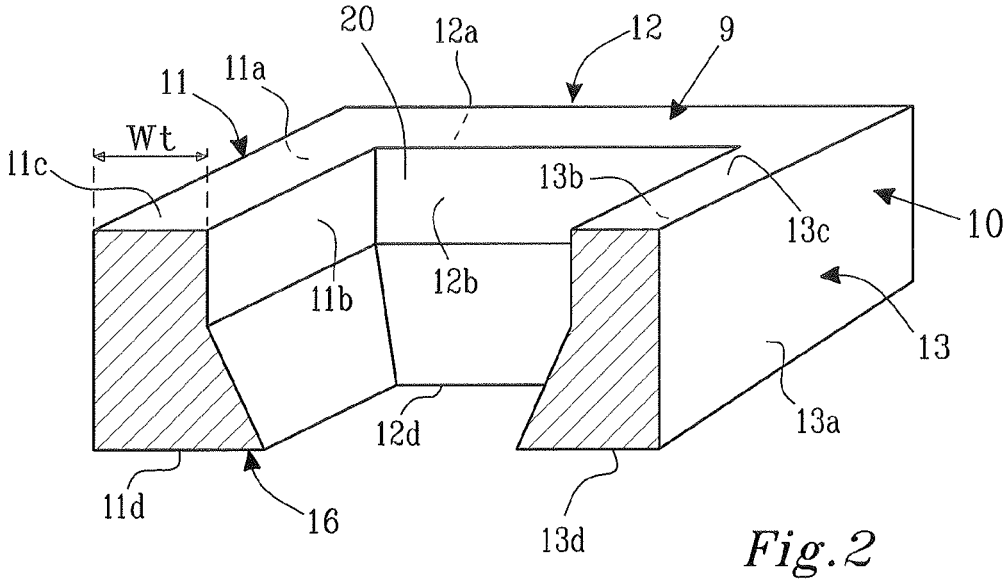
FIG. 2 shows a cross section of parts of the semi-submersible platform body as seen in FIG. 1, with a view in perspective.

FIG. 2 shows a schematic cross section of the platform body 10 as seen in perspective. The platform body 10 comprises a substantially rectangular hull formed by four side wall sections; the first, the second, the third and the forth side wall section 11, 12, 13, 14, wherein only the first, the second, the third 11, 12, 13 are shown in FIG. 2. Each side wall section 11, 12, 13, 14 exhibit a side wall thickness Wt and a first and a second side 11*a*, 11*b*, 12*a*, 12*b*, 13*a*, 13*b* (14*a*, 14*b* not shown). The side wall sections 11, 12, 13, 14 have an equal in height as the height H of the platform body, however, some side wall sections can be lower than the height H of the platform body, as will be described in greater detail below. Each side wall section 11, 12, 13, 14 further comprises an upper and a lower edge 11*c*, 11*d*, 12*c*, 12*d*, 13*c*, 13*d* (14*c*, 14*d* not shown). The first side of each side wall sections faces towards the open sea (away from the centre of the platform body) and the second side of each side wall section faces towards the centre of the platform body 10 to thereby form an open recess 20. In the shown embodiment of the present invention, the open recess 20 extends through the whole of the platform body 10. A bottom 16 of the side wall sections 11, 12, 13, 14 faces the sea floor 4 and defines a bottom surface area. The operational deck 7 may or may not cover the open recess 20. In FIG. 1, the operational deck 7 is arranged below the upper edge 11*c*, 12*c*, 13, 14*c*, of each of the side wall section 11, 12, 13, 14 as will be described in greater detail with reference to FIG. 3.

Figure 3:
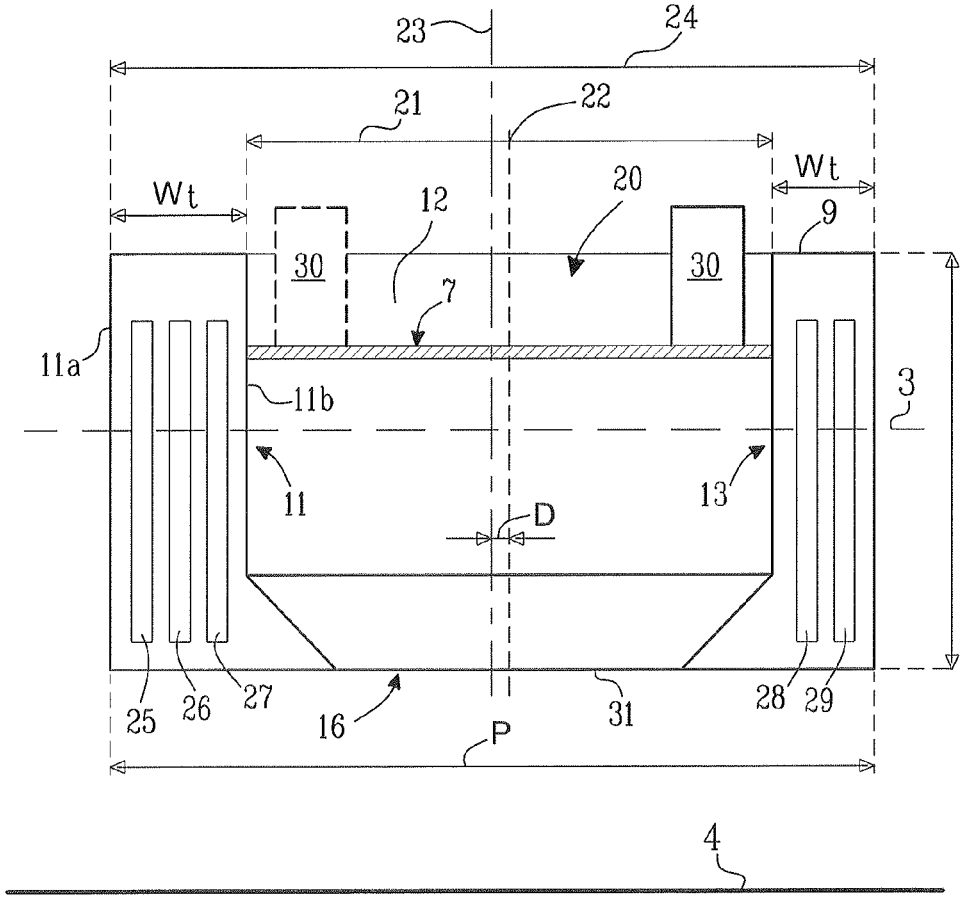
FIG. 3 shows a cross section of an embodiment of a semi-submersible platform body, according to the present invention, with a view from one side.

FIG. 3 shows a cross section of the platform body 10 across the first and third side wall section 11, 13, as shown in FIG. 2 and with a view from the side, straight into the open recess 20 and to the second side wall 12. The sea level 3 and the sea floor 4 can be seen. The first side wall 11 comprises a side wall thickness Wt which is substantially larger than the side wall thickness Wt of the third side wall 13. In more general terms, the cross section 21 of the open recess 20 comprises a centre point 22 which is displaced from the centre point 23 of the cross section 24 of the platform body 10.

As an effect of the displaced centre point 22 of the cross section 21 of the open recess 20 with respect to the centre point 23 of the cross section 24 of the platform body 10, the ballast in each of the side wall sections can easily be displaced to provide for free localization of e.g. a LNG plant 30 arranged on the platform body 10. Inertia and the offset of the point of balance which is imparted by the LNG plant 30 can easily be compensated by the effective space made available by the displaced centre point 22 of the cross section 22 of the open recess 20. In the shown embodiment of the present invention, this is achieved by making at least one of the side wall sections thicker than the other side wall sections. The first side wall section 11 can, by way of example only, be arranged to comprise three storage tanks 25, 26, 27 for storing hydrocarbons, preferably LNG, while the opposite third side wall section 13 comprises only two storage tanks 28, 29. Should it be desirable to store solid matter, compartments of different sizes, proportional to the difference in thickness of the walls, can easily replace or be combined with the above mentioned storage tanks.

As a preferred option, and as an indication of the flexibility of the present invention, to the location of the LNG plant 30 in FIG. 3, the plant may instead be located in the vicinity of, or on, the first side wall 11. This is indicated as a dotted line in FIG. 3 with the reference 30. Moving the LNG plant 30, which generally has a large mass, towards the first side wall 11 will consequently move the horizontal centre of gravity of the platform 1 towards the first side wall as well. However, since the centre of buoyancy of the platform body 10 also is located towards the first side wall, a balanced system, i.e. a system wherein the horizontal centre of gravity of the platform coincides with the horizontal centre of buoyancy of the platform body may be obtained with only a small amount of additional ballast water in the platform 1. This will provide for several advantages, such as an increased deck carrying capacity of the platform 1.

In an embodiment of the present invention, the distance between the first side 11*a* and the second side 11*b* of the first side wall section 11 is not constant throughout the height H of the side wall section 11. As can be seen from FIGS. 2 and 3, the first side 11*a*, 12*a*, 13*a*, 14*a* is substantially vertical, likewise a part of the second side 11*b*, 12*b*, 13*b*, 14*b* extends substantially vertical, parallel with the first side 11*a*, 12*a*, 13*a*, 14*a* of the side wall sections 11, 12, 13, 14. A part of the second sides 11*b*, 12*b*, 13*b*, 14*b*, of the side wall sections 11, 12, 13, 14 are however, in the shown embodiment of the present invention, slightly angled towards the centre of the open recess 20.

The side wall thickness increases towards the bottom 16 of the side walls, and as a consequence, the area of the cross section of the open recess 20 decreases. A first plane P extends substantially parallel with the operational deck 7 and separates the open recess 20 in a first and a second section. The cross section 22 of the open recess in the first plane P comprises a first cross section area. The open recess 20 further comprises a second cross section area below the first plane (P) and a third cross section area in the plane of the bottom 16. The first cross section area is at least 10%, preferably 20% larger than the second cross section area.

The third cross section area of the open recess 20 is in the plane of the bottom 16 smaller than the first cross section area of the open recess 20 in the first plane P. The effect of this feature is that, during a storm, the maximum wave elevation inside the open recess 20, and at the second side of the side wall section, is significantly reduced as compared to the maximum wave elevation present at the first side of the side wall section, i.e. outside of the open recess 20 without compromising with the available area of open water inside the open recess 20. The available area of open water permits sea vessels or equipment to be stored or anchored to the platform body, either directly to the second side 11*b*, 12*b*, 13*b*, 14*b* of the side wall sections or optionally on a jetty or the like. This further permits an even lower position of the operational deck 7, which can be advantageous due to the simultaneous lowering of the point of balance, i.e. the centre of gravity. More specifically, this reduction of maximum wave elevation inside the open recess provides for that equipment, such as a deck, inside the recess 20 may be arranged at a static air gap, i.e. vertical distance to the still water level, which is lower than what would be required, should the same equipment be located on the outside of the platform body 10. This reduction of static air gap, i.e. the reduction of the maximum wave elevation, with respect to e.g. equipment in the open recess while still obtaining an appropriately large clearance between wave crests and the equipment, in turn provides for that the vertical centre of gravity of the platform 1 may be reduced. A reduction of the vertical centre of gravity generally results in an increased stability of the platform and subsequently increases the deck carrying capacity of the platform 1.

Figure 4A:
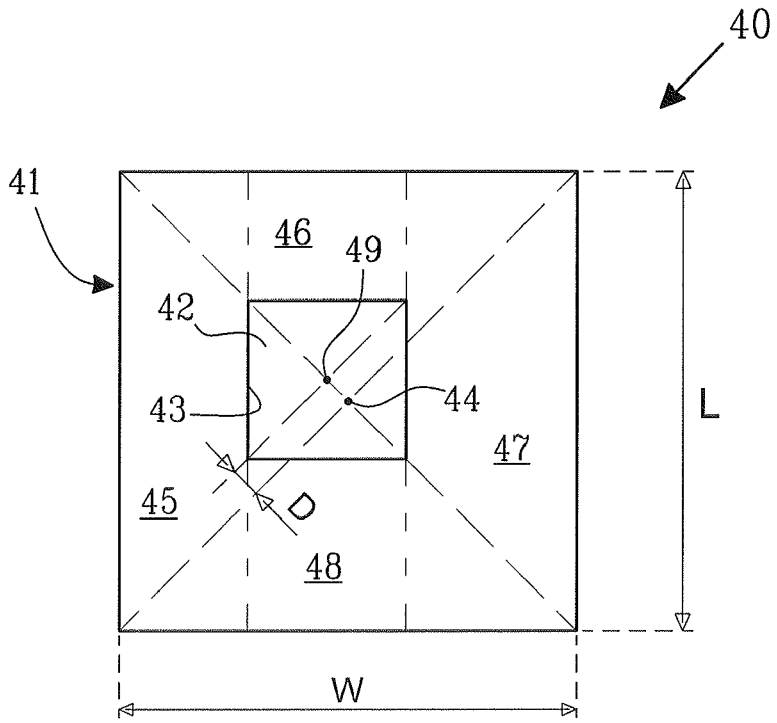
FIG. 4*a*-4*c* shows cross sections of different embodiments of a semi-submersible platform body, according to the present invention, with a view from above.
Figure 4B:
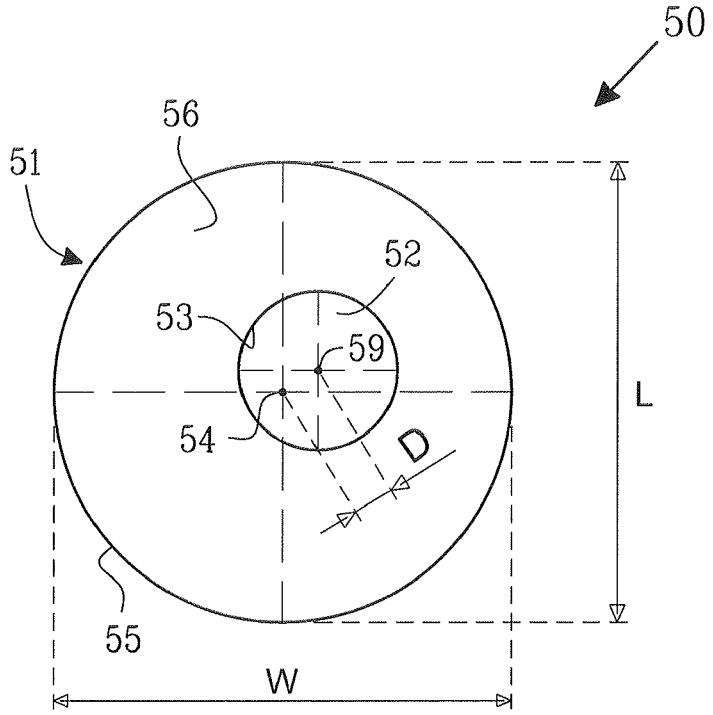
Figure 4C:
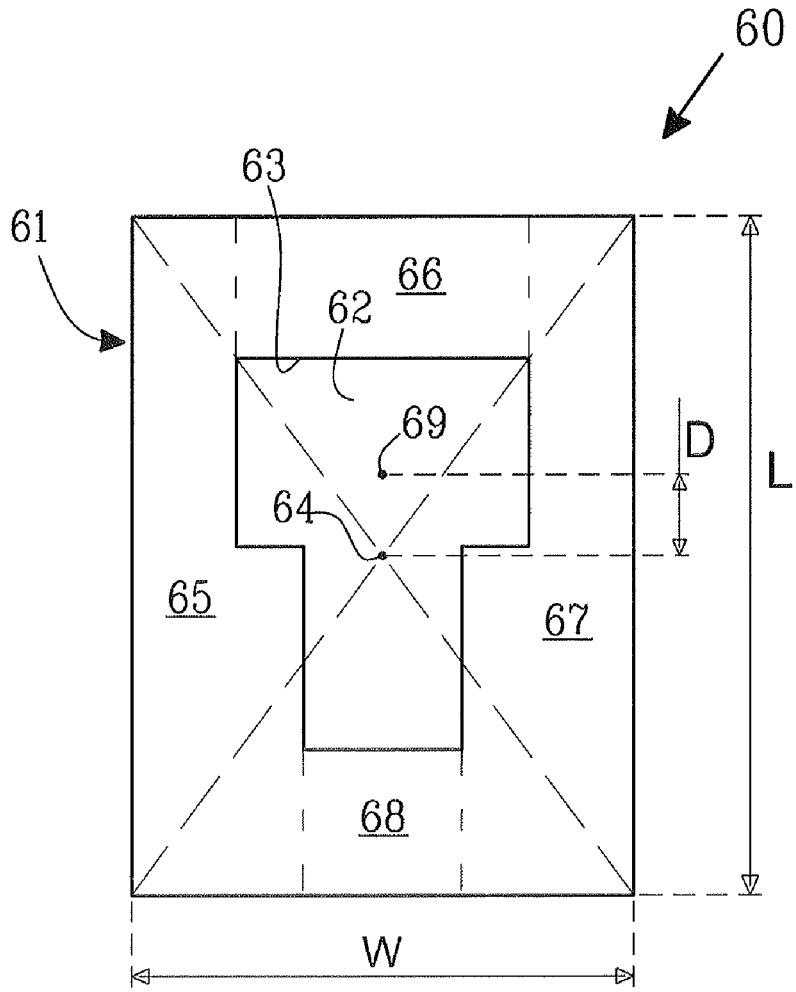

Turning to FIG. 4*a*-*c*, FIG. 4*a*-*c* shows different, non limiting embodiments of semi-submersible platform bodies, according to the present invention, as seen along a cross section in a first plane P, and from above. In FIG. 4*a* is a platform body 40 shown with a substantially square formed cross section 41 and a substantially square formed open recess 42 with a cross section 43. A first, second, third and fourth side wall section 45, 46, 47, 48 are arranged around the periphery of an open recess 42. The squared formed cross section 41 of the platform body 40 comprises a centre point 44 which is defined as the intersection of the diagonals of the substantially squared formed cross section 41 of the platform body 40. Likewise, the squared formed cross section 45 of the open recess 42 comprises a centre point 49 which is defined as the intersection of the diagonals of the substantially squared formed cross section 43. The centre points 44, 49 of each cross section 41, 43 are displaced with a distance D with respect to each other.

In FIG. 4*b* is a semi-submersible platform body 50 shown with a circular cross section 51 and a substantially circular formed open recess 52 with a cross section 53. A side wall 55 encompasses and forms the open recess 52, i.e. it is arranged around the periphery if the open recess 52. This embodiment comprises only one side wall section 55. The circular formed cross section 51 of the platform body 50 comprises a centre point 54 at the origin of the substantially circular formed cross section 51 of the platform body 50. Likewise, the circular formed cross section 53 of the open recess 52 comprises a centre point 59 at the origin of the substantially circular formed cross section 53. The centre points 54 and 59 of each cross section 51, 53 are displaced with a distance D with respect to each other.

FIG. 4*c* illustrates another embodiment of a semi-submersible platform body 60 according to the present invention. The semi-submersible platform body 60 comprises a substantially rectangular formed cross section 61 with a centre point 64 defined as the intersection of the two diagonals of the rectangular cross section. A plurality of sidewall sections 65, 66, 67, 68 forms an open recess 62 having an asymmetric cross section 63 and a centre point 69. The centre points 64 and 69 of each cross section 61, 63 are displaced with a distance D with respect to each other.

In cases where no centre point of the cross section can easily be identified, the centre point is to be defined as the point of balance of the cross section, calculated as if the open recess is absent, and illustrated as in the FIGS. 4*a*-4*c*, i.e. as seen from above. Likewise, if the centre point of the cross section of the open recess cannot easily be identified, the centre point is to be defined as the point of balance of the cross section (in principle treated as if the open recess was a homogenous piece of material). This is specially the case when the cross sections of the open recess and/or the platform body have an asymmetric form.

The offset in the above described embodiments provides for a platform body with asymmetric properties which can be better utilized for storing hydrocarbons while at the same time provide for an asymmetric positioning of equipment or facilities e.g. a production plant, such as a LNG plant, or a refinery of the like. An asymmetric positioning of facilities has been found to be very important since many facilities for offshore treatment of hydrocarbons has been shown to require custom solutions.

Figure 5A:
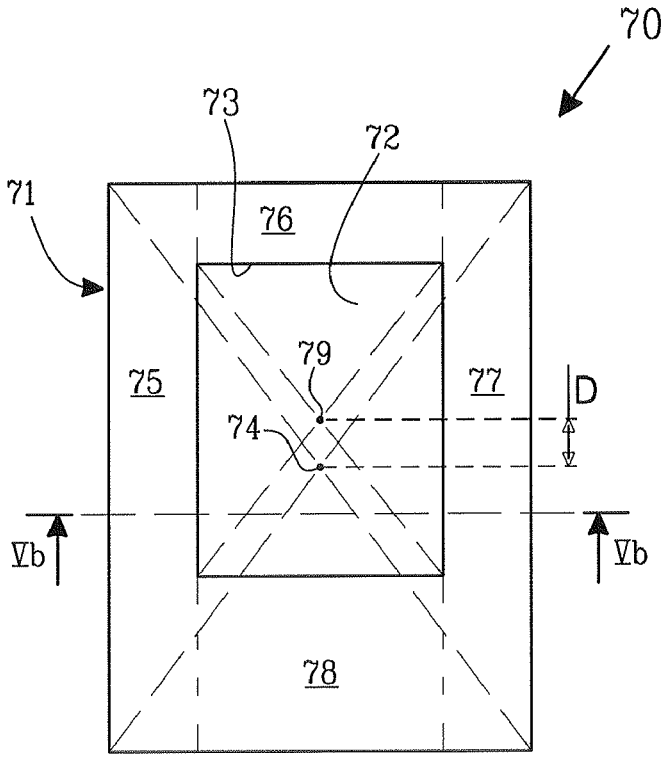
FIG. 5*a*-5*b* shows a cross section, with a view from above and from the side, of an embodiment according to the present invention.

As is noted, a displacement between the two centre points can be provided when the hull and/or the open recess are asymmetric in their selves. FIG. 5*a* shows an embodiment of a semi-submersible platform body, according to the present invention, illustrated with a view from above. A plurality of sidewall sections 75, 76, 77, 78 forms an open recess 72 having a symmetric cross section 73 and a centre point 79. The semi-submersible platform body 70 comprises a substantially rectangular cross section 71 with a centre point 74 defined as the point of balance of the cross section 71 of the platform body 70, as if the open recess 72 is absent (in the same way as in FIG. 4*a*-4*c*). The centre points 74 and 79 of each cross section 71, 73 are displaced with a distance D with respect to each other.

Figure 5B:
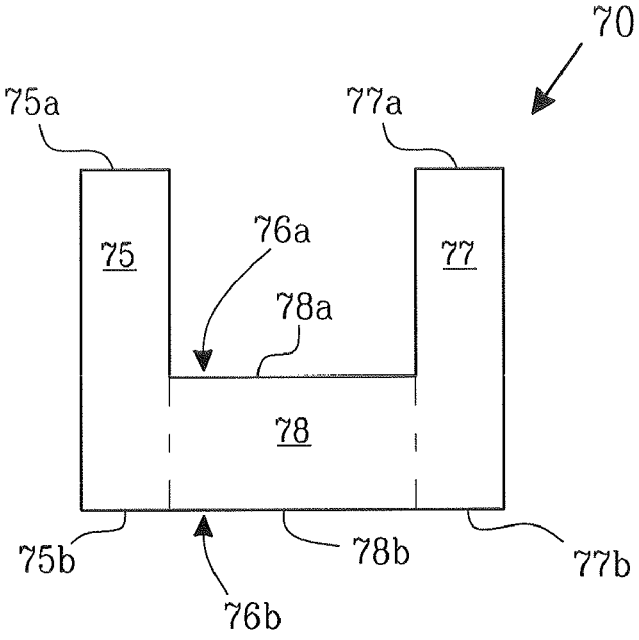

FIG. 5*b* illustrates the semi-submersible platform body 70 as shown in FIG. 5*a* with a view towards the fourth side wall section 78. Each of the side wall sections 75, 76, 77, 78 comprises an upper and a lower edge 75*a*, 75*b*, 76*a*, 76*b*, 77*a*, 77*b*, 78*a*, 78*b* respectively. The upper edges 76*a*, 78*a* of the second and fourth side wall sections 76, 78 are arranged below the upper edges 75*a*, 77*a* of the first and second side wall sections 75, 77. This effectively provides for mating properties to the semi-submersible platform body 70 to mate with e.g. a LNG plant module. As can be seen in FIG. 5*a*, each cross section is displaced with respect to each other. Thus, during the installation of e.g. a LNG plant module on the platform body 70 the platform body 70 may firstly be lowered such that the still water line is above the upper edges 76*a*, 78*a* of the second 76 and fourth 78 wall sections, i.e. a clearance is obtained between the still water surface and the upper edges 76*a*, 78*a*. Purely by way of example, the aforementioned clearance may be in the range of 5 meters. Then, a barge (not shown) carrying the LNG plant module is introduced in the open recess 72, which introduction is enabled by the aforementioned clearance. The LNG plant may then the attached to the platform body 70, e.g. by means of welding, and the barge may thus be removed from the open recess 72. Then, the draft of the platform body 70 is reduced to its operating draft, i.e. the platform body 70 is raised.

The offset of the centre points of the cross sections of the open recess and the semi-submersible platform body provides for a displacement of the point of balance to the semi-submersible platform body, which in turn provides for a more versatile platform body in terms of storage of hydrocarbon and positioning of facilities such as plants, equipment or the like, without reducing the storage capacity. Although some features might have been described with respect to only one side wall section, it is well within the boundaries of the present invention that these features can be arranged to one or more side wall sections, opposing side wall sections, adjacent side wall sections, combinations of these, or optionally present on all side wall sections or the like.

The invention claimed is:

1. A semi-submersible platform body for supporting drilling, storing, treatment, or production of hydrocarbons, comprising:

a platform body adapted to float in a body of water, said platform body having a length, a width, and a cross section with a centre point in a first plane, wherein said width is at least 70% of said length, wherein said platform body is defined by a side wall formed by at least one side wall section, wherein said side wall is arranged around a periphery of an open recess, wherein each side wall section comprises a first side and a second side and an upper edge and a lower edge, wherein said lower edge is adapted to be located in said body of water and said upper edge is adapted to be located above said body of water when said platform body floats in said body of water, wherein said first and second sides of said side wall section define at least a first side wall thickness, wherein said first side of said side wall section faces away from said open recess and said second side of said side wall section faces towards said open recess, said open recess having a cross section with a centre point in said first plane, and wherein said centre point of said cross section of said open recess is displaced a distance in said first plane from said centre point of said cross section of said platform body.

2. The semi-submersible platform body according to claim 1, wherein said centre point of said cross section of said open recess is displaced from said centre point of said cross section of said platform body a distance of between 0.1 m to 40 m.

3. The semi-submersible platform body according to claim 1, wherein said platform body comprises a polygonal cross section with at least a first, second, and third side wall section, and said first side wall section comprises a side wall thickness that is at least 105% of said side wall thickness of said second or third side wall sections.

4. The semi-submersible platform body according to claim 3, wherein said platform body comprises a substantially rectangular cross section with a first, second, third, and fourth side wall section, and wherein said first side wall section comprises a side wall thickness that is at least 105% of said side wall thickness of said second, third, or fourth side wall section.

5. The semi-submersible platform body according to claim 4, wherein two of said side wall sections comprise a side wall thickness that is at least 105% of the largest side wall thickness of said remaining side wall sections.

6. The semi-submersible platform body according to claim 5, wherein said first, second and third side wall sections comprise a side wall thickness that is at least 105% of said side wall thickness of said fourth side wall section.

7. The semi-submersible platform body according to claim 1, wherein said cross section of said open recess comprises a polygonal cross section.

8. The semi-submersible platform body according to claim 7, wherein said cross section of said open recess comprises a rectangular cross section.

9. The semi-submersible platform body according to claim 1, wherein said side wall thickness above said first plane is different than said side wall thickness below said first plane.

10. The semi-submersible platform body according to claim 1, further comprising an operational deck disposed below said upper edge of said at least one side wall section.

11. The semi-submersible platform body according to claim 1, wherein said cross section of said platform body has an area, and wherein said cross section of said open recess has an area, wherein a ratio between said area of said cross section of said platform body and said area of said cross section of said open recess is at least 1.1:1.

12. The semi-submersible platform body according to claim 11, wherein said ratio is between 1.1:1 and 15:1.

13. The semi-submersible platform body according to claim 12, wherein said ratio is between 1.1:1 and 10:1.

14. The semi-submersible platform body according to claim 1, wherein said side wall thickness above said first plane is different than said side wall thickness below said first plane, and wherein said side wall thickness below said first plane increases towards said lower edge of said side wall section.

15. The semi-submersible platform body according to claim 1, further comprising an operational deck disposed below said upper edge of said side wall section to form an air gap located between said upper edge of said side wall section and the operation deck.

16. The semi-submersible platform body according to claim 2, wherein said centre point of said cross section of said open recess is displaced from said centre point of said cross section of said platform body by a distance of between 3 m to 30 m.

17. A semi-submersible platform body for supporting drilling, storing, treatment, or production of hydrocarbons, comprising:

a platform body having a length, a width, and a cross section with a centre point in a first plane, wherein said width is at least 70% of said length, wherein said platform body is defined by a side wall formed by at least one side wall section, wherein said side wall is arranged around a periphery of an open recess, wherein each side wall section comprises a first side and a second side and an upper edge and a lower edge, wherein said first and second sides of said side wall section define at least a first side wall thickness, wherein said first side of said side wall section faces away from said open recess and said second side of said side wall section faces towards said open recess, wherein said open recess has a cross section with a centre point in said first plane, wherein said centre point of said cross section of said open recess is displaced a distance in said first plane from said centre point of said cross section of said platform body, wherein said cross section of said open recess in said first plane comprises a first cross sectional area, wherein said open recess comprises a second cross sectional area below said first plane, and wherein said first cross sectional area is at least 10% larger than said second cross sectional area.

18. The semi-submersible platform body according to claim 17, wherein said side wall comprises a bottom, said bottom defines a side wall bottom surface area, and wherein a third cross sectional area of said open recess, in the plane of said bottom surface area, is less than 50% of said bottom surface area.

19. The semi-submersible platform body according to claim 17, wherein said first side of said side wall section is substantially vertical, and wherein said second side of said side wall section is arranged with an angle, with respect to said first side of said side wall section, so that said increase in said side wall thickness is effected.

20. The semi-submersible platform body according to claim 17, wherein said first cross sectional area is at least 20% larger than said second cross sectional area.

21. A semi-submersible platform body for supporting drilling, storing, treatment or production of hydrocarbons, comprising:

a platform body having a length, a width, and a cross section with a centre point in a first plane, wherein said width is at least 70% of said length, wherein said platform body is defined by a side wall formed by at least one side wall section, wherein said side wall is arranged around a periphery of an open recess, wherein each side wall section comprises a first side and a second side and an upper edge and a lower edge, wherein said first and second sides of said side wall section define at least a first side wall thickness, wherein said first side of said side wall section faces away from said open recess and said second side of said side wall section faces towards said open recess, wherein said open recess has a cross section with a centre point in said first plane, wherein said centre point of said cross section of said open recess is displaced a distance in said first plane from said centre point of said cross section of said platform body, wherein said side wall thickness above said first plane is different than said side wall thickness below said first plane, and wherein said side wall thickness below said first plane is continuously increasing towards said lower edge of said side wall section.

22. A semi-submersible platform body for supporting drilling, storing, treatment, or production of hydrocarbons, comprising:

a platform body having a length, a width, and a cross section with a centre point in a first plane, wherein said width is at least 70% of said length, wherein said platform body is defined by a side wall formed by at least one side wall section, wherein said side wall is arranged around a periphery of an open recess, wherein each side wall section comprises a first side and a second side and an upper edge and a lower edge, wherein said first and second sides of said side wall section define at least a first side wall thickness, wherein said first side of said side wall section faces away from said open recess and said second side of said side wall section faces towards said open recess, wherein said open recess has a cross section with a centre point in said first plane, wherein said centre point of said cross section of said open recess is displaced a distance in said first plane from said centre point of said cross section of said platform body; and an operational deck disposed below said upper edge of said side wall section to form an air gap located between said upper edge of said side wall section and the operation deck.

23. A semi-submersible platform body for supporting drilling, storing, treatment, or production of hydrocarbons, comprising:

a platform body having a length, a width, and a cross section with a centre point in a first plane, wherein said width is at least 70% of said length, wherein said platform body is defined by a side wall formed by at least one side wall section, wherein said side wall is arranged around a periphery of an open recess, wherein each side wall section comprises a first side and a second side and an upper edge and a lower edge, wherein said first and second side of said side wall section define at least a first side wall thickness, wherein said first sides of said side wall section faces away from said open recess and said second side of said side wall section faces towards said open recess, wherein said open recess has a cross section with a centre point in said first plane, wherein said centre point of said cross section of said open recess is displaced a distance in said first plane from said centre point of said cross section of said platform body, and wherein said side wall comprises at least two side wall sections, wherein at least one of said side wall sections comprises an upper edge arranged below said upper edge of said remaining side wall sections.

24. The semi-submersible platform body according to claim 23, wherein said side wall comprises at least three side wall sections, wherein at least two of said side wall sections comprise an upper edge arranged below said upper edge of said remaining side wall sections.

* * * * *